US009615633B2

(12) United States Patent
Takahashi

(10) Patent No.: US 9,615,633 B2
(45) Date of Patent: Apr. 11, 2017

(54) BUCKLE

(75) Inventor: Yoshinobu Takahashi, Toyama (JP)

(73) Assignee: YKK Corporation (JP)

( * ) Notice: Subject to any disclaimer, the term of this patent is extended or adjusted under 35 U.S.C. 154(b) by 96 days.

(21) Appl. No.: 14/423,159

(22) PCT Filed: Aug. 23, 2012

(86) PCT No.: PCT/JP2012/071357
§ 371 (c)(1),
(2), (4) Date: Feb. 23, 2015

(87) PCT Pub. No.: WO2014/030245
PCT Pub. Date: Feb. 27, 2014

(65) Prior Publication Data
US 2015/0237971 A1 Aug. 27, 2015

(51) Int. Cl.
*A44B 11/26* (2006.01)
*A44B 11/00* (2006.01)

(52) U.S. Cl.
CPC ..... *A44B 11/266* (2013.01); *A44B 11/006* (2013.01); *Y10T 24/4086* (2015.01); *Y10T 24/45524* (2015.01); *Y10T 24/45529* (2015.01)

(58) Field of Classification Search
CPC . A44B 11/266; A44B 11/006; A44B 11/2592; A44B 11/2561; A44B 11/25; Y10T 24/45524; Y10T 24/45529
USPC ..... 24/614, 615, 616
See application file for complete search history.

(56) References Cited

U.S. PATENT DOCUMENTS 5,465,472 A 11/1995 Matoba
5,507,076 A * 4/1996 Anscher ..... A44B 11/266 24/616
5,794,316 A 8/1998 Anscher
6,931,695 B2 * 8/2005 Anscher ..... A44B 11/26 24/614
7,181,813 B2 * 2/2007 Chen ..... A44B 11/266 24/625

(Continued)

FOREIGN PATENT DOCUMENTS

JP 7-289310 A 11/1995
JP 2533866 Y2 4/1997

(Continued)

OTHER PUBLICATIONS

International Preliminary Report on Patentability, PCT Application No. PCT/JP2012/071357, mailed Mar. 5, 2015.

(Continued)

*Primary Examiner* — Robert J Sandy
(74) *Attorney, Agent, or Firm* — Kilpatrick Townsend & Stockton LLP

(57) ABSTRACT

A buckle which includes a socket and a plug. The socket includes: a cylindrical main body; a hollow part formed within the main body; a pair of left and right openings continuous to the hollow part and penetrating through wall parts of the main body; and a pair of left and right first latch surfaces defined on opening-side wall surfaces of the wall parts of the main body and inclined in a direction intersecting with an insertion direction of the plug. The plug includes: a base; arms; and a pair of left and right second latch surfaces protruding outward from outer sides of the arms and inclined in the direction intersecting with the insertion direction of the plug.

4 Claims, 8 Drawing Sheets

(56) References Cited

U.S. PATENT DOCUMENTS

| | | | | |
|---|---|---|---|---|
| 7,681,288 | B1 * | 3/2010 | Giampavolo | A44B 11/266 24/614 |
| 7,685,685 | B2 * | 3/2010 | Giampavolo | A44B 11/266 24/614 |
| 2006/0272136 | A1 * | 12/2006 | Chui | A44B 11/266 24/614 |
| 2010/0293763 | A1 * | 11/2010 | Paik | A44B 11/266 24/614 |

FOREIGN PATENT DOCUMENTS

| | | | |
|---|---|---|---|
| JP | 9-206113 | A | 8/1997 |
| JP | 10-57114 | A | 3/1998 |
| JP | 3094125 | U | 6/2003 |

OTHER PUBLICATIONS

International Search Report, PCT Application No. PCT/JP2012/071357, mailed Nov. 13, 2012.

Office Action, Taiwanese Patent Application No. 102128300, mailed Sep. 22, 2015.

* cited by examiner

BUCKLE

This application is a national stage application of PCT/JP2012/071357, which is incorporated herein by reference.

TECHNICAL FIELD

The present invention relates to a male and female member, more specifically, a side engagement buckle in which a plug and a socket can be detachably engaged with each other at openings formed on both sides of the socket.

BACKGROUND ART

In various use applications such as cloths, bags, shoes, packing materials and the like, a buckle which includes a plug and a socket to connect corded members, such as belts and the like, to each other has been known. The plug includes a base having an attachment for attaching a corded member, and a pair of left and right arms extending from one end of the base. The socket includes a cylindrical main body having a hollow part to accommodate therein the arms of the plug. Openings to engage the arms of the plug are provided on both sides of this main body. It is called as a side engagement buckle (side release buckle) since the plug and the socket are detachably engaged at the openings formed on both sides of the main body of the socket.

As an example of the side release buckle, for example, U.S. Pat. No. 5,794,316 (Patent Document 1) discloses an example in which V-shaped stop members are provided within a socket member, and V-shaped latch surfaces are placed on the arms of the plug member. The plug member and the socket member are detachably connected to each other as the arms of the plug member is inserted into the socket member and the V-shaped stop members and the V-shaped latch surfaces are engaged with each other on both sides of the socket member.

Japanese Utility Model Registration No. 2533866 (Patent Document 2) discloses an example of a side release buckle of a front and back engagement type, which includes a buckle main body and an insertion body. Since engagement units placed on front and back sides of a tip of a leg of the insertion body and a second engagement unit placed on a central side of the leg are engaged with or disengaged from engagement units placed on a buckle main body side, respectively, the buckle main body and the insertion body are attached to or detached from each other.

CITATION LIST

Patent Literatures

Patent Literature 1: U.S. Pat. No. 5,794,316
Patent Literature 2: Japanese Utility Model Registration No. 2533866

SUMMARY OF INVENTION

Problem to be Solved by the Present Invention

However, in a case of the side engagement buckles described in the patent document 1 and the patent document 2, their shapes are very complicated, and their forming works are difficult. For this reason, it has been desired to realize a buckle, which is simple in configuration as compared with a conventional buckle and has a sufficient strength to an extent that the buckle is not easily separated after the plug is inserted into the socket, and can be removed by a small load when the buckle is detached.

In view of the above problems, the present invention provides a buckle that is simple in configuration and has a high strength to an extent that an engagement state between a plug and a socket can be kept without any separation of the plug, even if the plug is pulled in a direction opposite to an insertion direction after the plug is inserted into the socket, and can be removed by a small load when the buckle is detached.

Means for Solving the Problem

In order to solve the above problems, the present inventor has considered to further simplify the configuration of the arms by employing a side engagement buckle in which only the sides of the arms are engaged with the socket, differently from the front and back engagement type described in the conventional technique. In addition to it, the present inventor has also considered that an idea of thickening base end portions of the arms extending from one end of the plug and consequently reinforcing its strength was effective in order to increase the strength to an extent that an engagement state between a plug and a socket could be kept even if the plug was pulled in a direction opposite to an insertion direction after the plug was inserted into the socket.

The strength was improved by thickening the base end portions of the arms, however, when the engagement state between the plug and the socket was disengaged (released), it became difficult to distort the pair of left and right arms in a direction in which they came close to each other. Thus, this idea was unsuitable for a realistic use. As a result of intensive studies made by the present inventor, it has been found and achieved a buckle according to the present invention by paying attention to the detailed shape of the plug, namely, the positional relation between the base end portions of the arms and latch surfaces protruded from the outer side of the arms.

According to an aspect of the present invention completed with the above knowledge as a basic, there is provided a buckle which includes a socket and a plug, the socket includes: a cylindrical main body having an insertion port into which the plug can be inserted at one end and an attachment to which a corded member is attachable at another end; a hollow part formed within the main body; a pair of left and right openings continuous with the hollow part and penetrating through wall parts the main body; and a pair of left and right first latch surfaces defined on an opening-side wall surfaces of the wall parts of the main body and exposed from the openings to the attachment, the opening-side wall surfaces inclined in a direction intersecting with an insertion direction (X) of the plug, wherein the plug includes; a base to which a corded member is attachable; a pair of left and right arms extended from one end of the base; and a pair of left and right second latch surfaces protruding outward from outer sides of the arms, respectively, and inclined in the direction intersecting with the insertion direction (X) of the plug, respectively, the second latch surfaces engagable with the first latch surfaces, and wherein inner ends of the second latch surfaces are brought into contact with lines (Y) that extend in parallel to the insertion direction (X) of the plug and pass through inner side portions located at the outermost portion on inner sides of proximal ends of the arms, or disposed further inside the lines (Y).

In the buckle according to the present invention, since the inner ends of the second latch surfaces are brought into contact with the lines (Y) that extend in parallel to the insertion direction (X) of the plug and pass through the inner side portions located at the outermost portion on the inner sides of the proximal ends of the arm, or disposed further inside the lines, the engagement between the second latch surfaces possessed by the plug and the first latch surfaces possessed by the socket are made surer. Hence, the plug is unlikely to be separated even if an external force is added in a direction in which the plug is pulled out from the socket, after the buckle is attached.

In the present invention and the following explanations, a direction that is relatively close to the central line is referred to be "inner (or inside)" and a direction far away from the center is referred to be "outer (or outside or outward)" in a case that the respective members of the socket and the plug are viewed from a central line (C) that passes through the centers of the socket and the plug and extends in parallel to the insertion direction (X) of the plug. In the present invention, "left and right" refer to both sides of two regions that are virtually partitioned by the above central line (C) on a planar view, and "left-right direction" refers to a direction vertical to the above mentioned central line or the insertion direction (X). For example, in FIG. 1, a direction that vertically intersects with the insertion direction (X) is the left-right direction, and a direction that is separated from the central line (C) of the socket and the plug is the outer direction, and a direction that approaches the central line (C) is the inner direction. For example, the above mentioned "a pair of left and right arms" represent that the arms are arranged so as to be separated from each other in the two regions virtually partitioned by the central line (C), on a flat surface where the socket and the plug are arranged.

In one embodiment of the buckle according to the present invention, an inclination angle θ of each of the second latch surfaces is between 10 degrees and 20 degrees. Here, the inclination angle θ refers to an angle in which, when a line Z which is vertical to the insertion direction X (or the line Y) of the plug is drawn, as shown in FIG. 3, an angle between the line Z and the second latch surface is measured from the line Z to a direction opposite to the insertion direction.

In another embodiment of the buckle according to the present invention, the buckle has a minimum tensile strength of 1335 N or more, and a release load of between 15 N and 25 N. Here, "the minimum tensile strength" refers to a force required until the plug is separated from the socket or one of the plug and socket is broken when the corded members respectively connected to the plug and the socket are pulled with a tension tester in a direction opposite to the insertion direction (X). "The release load" refers to a force required until the engagement state between the first latch surfaces and the second latch surfaces are disengaged when ends of the pair of left and right arms of the plug are pushed with a measurement unit in a direction in which the ends come close to each other.

According to the present invention, it is possible to provide the buckle that is simple in the configuration and has a high strength to the extent that the engagement state between the plug and the socket can be kept without any separation of the plug, even if the plug is pulled in the direction opposite to the insertion direction after the plug is inserted into the socket, and can be removed by the small load when the buckle is detached.

DESCRIPTION OF EMBODIMENTS

The embodiments of the present invention will be described below with reference to the drawings. In the descriptions of the following drawings, the same or similar symbols are assigned to the same or similar portions. The embodiments as described below exemplify an apparatus for embodying the technical idea of the present invention, and in the technical idea of the present invention, the structures, arrangements, material qualities and the like of their configuration parts are not specified to the followings.

Figure 1:
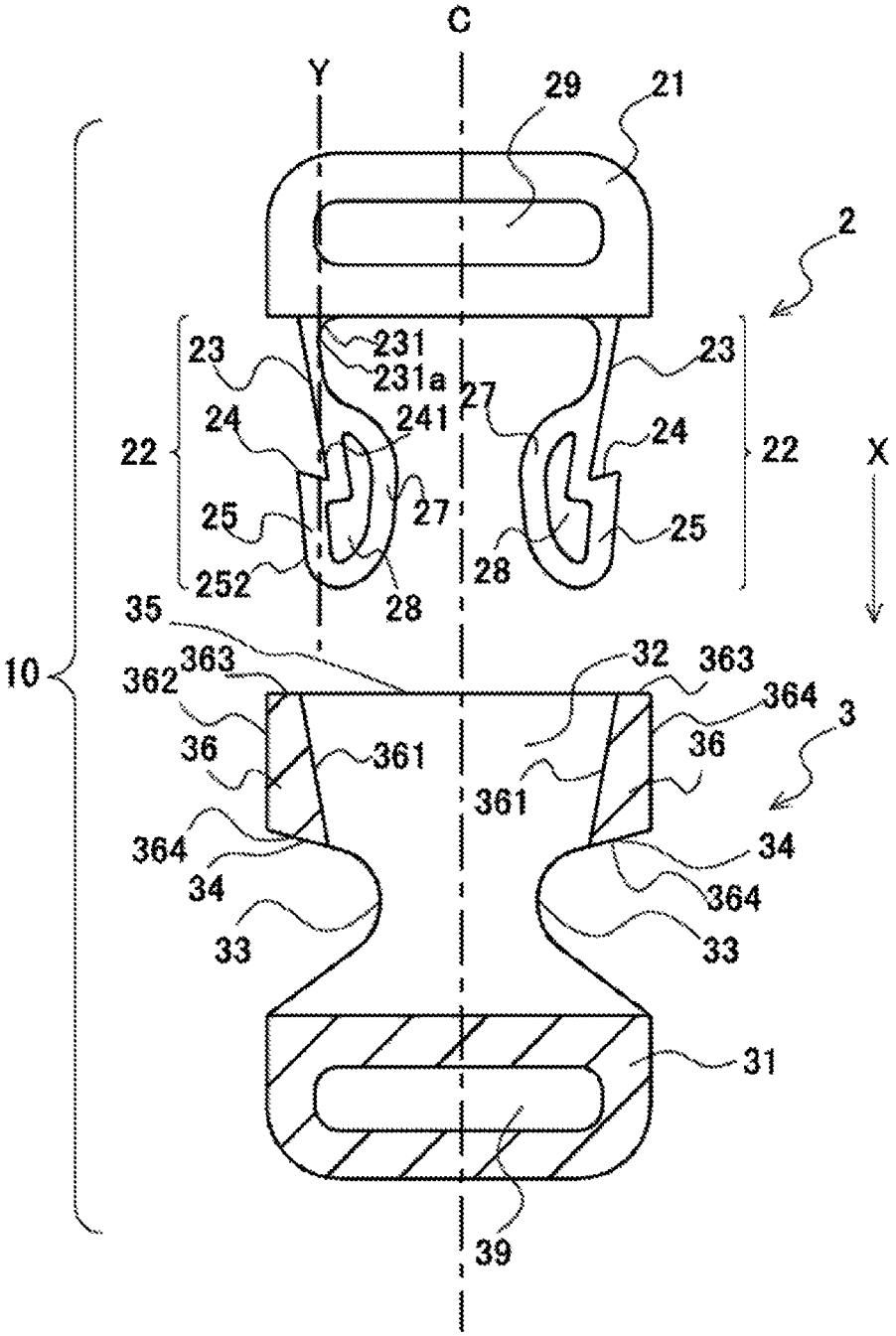
FIG. 1 is a partial cross-sectional view showing a buckle according to an embodiment of the present invention.

As shown in FIG. 1, a buckle 10 according to the embodiment of the present invention includes a plug 2 and a socket 3 which is inserted into and engaged with the plug 2. The socket 3 is made of metal, plastic or the like. The socket 3 includes a cylindrical main body 31 having an insertion port 35 into which the plug 2 can be inserted at one end and an attachment 39 to which a corded member is attachable at another end. A hollow part 32 is formed within the main body 31. The main body 31 has a pair of left and right openings 33 which are formed continuously to the hollow part 32 and penetrating through wall parts 36 of the main body 31.

Figure 2:
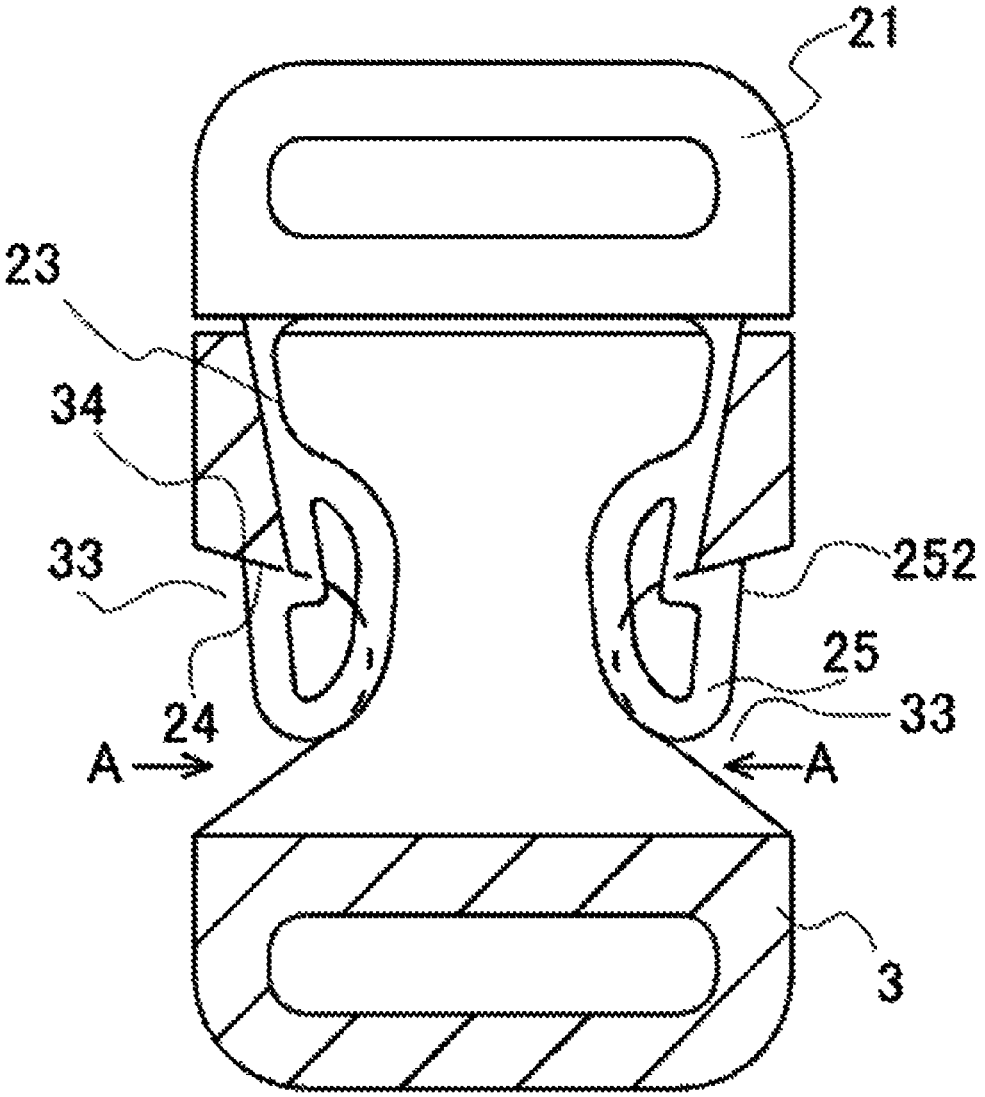
FIG. 2 is a cross-sectional view showing a situation when the buckle according to the embodiment of the present invention is attached.

As shown in FIG. 2, the wall parts 36 of the main body 31 serve as a role of regulating the plug 2 from being moved in an insertion direction (X) so that the plug 2 is not separated from the socket 3, after the plug 2 is inserted into the socket 3, in engagement with the plug 2. As shown in FIG. 1, the wall parts 36 have inner wall surfaces 361 facing the hollow part 32, outer wall surfaces 362 opposite to the inner wall surfaces 361; insertion-port-side wall surfaces 363 connected between the inner wall surfaces 361 and the outer wall surfaces 362 provided on the side of the insertion port 35; and opening-side wall surfaces 364 connected between the inner wall surfaces 361 and the outer wall surfaces 362 and exposed from the openings 33 to the attachment 39. The opening side wall surfaces 364 are extended while being inclined in a direction intersecting with the insertion direction (X) of the plug 2 and also defined as first latch surfaces 34 to be engaged with second latch surfaces 24 which will be described later. Inclination angles of the first latch surfaces 34 are made equal to those of the second latch surfaces 24 so as to correspond to the second latch surfaces 24 which will be described later, or formed to be inclined at angles equal to or greater than those of the second latch surfaces 24, toward the sides opposite to the insertion direction (X), as those inclinations approach the outer sides from the inner sides of the first latch surfaces 34.

The plug 2 is plate-shaped and made of metal, plastic or the like. The plug 2 includes a base 21 having an attachment 29 to which a corded member can be attached and a pair of left and right arms 22 extended from one end of the base 21. The arms 22 are formed in symmetry with respect to a central line (C) of the arms 22. Each of the arms 22 includes a pillared proximal end 23 connected to the base 21 and a distal end 25 continuous to the proximal end 23 and further protruded from the proximal end 23 to the side of the insertion direction (X) of the plug 2. Each of the proximal ends 23 is arranged so as to gradually approach an inside (a direction in which both of the proximal ends 23 come close to each other). A swell portion 27 that is inwardly swelled is formed in the distal end 25. A hole 28 is made in a center of the swell portion 27. The hole 28 is made in order to suppress a void from being generated at a time of resin molding and give a uniform thickness to the plug 2. However, the hole 28 may be absent. In order that the plug 2 is inserted into and engaged with the socket 3, each of the second latch surfaces 24 that is engaged with each of the first latch surface 34 of the socket 3 is formed on the center of the outer surface of each of the arms 22. As shown in FIG. 1, each of the second latch surfaces 24 is an inclination surface that is protruded in the outer direction from the outer side of the center of each of the arms 22 and inclined with respect to the insertion direction (X) and extended in a direction intersecting the outer side of the proximal end 23 of the arm 22.

Figure 3:
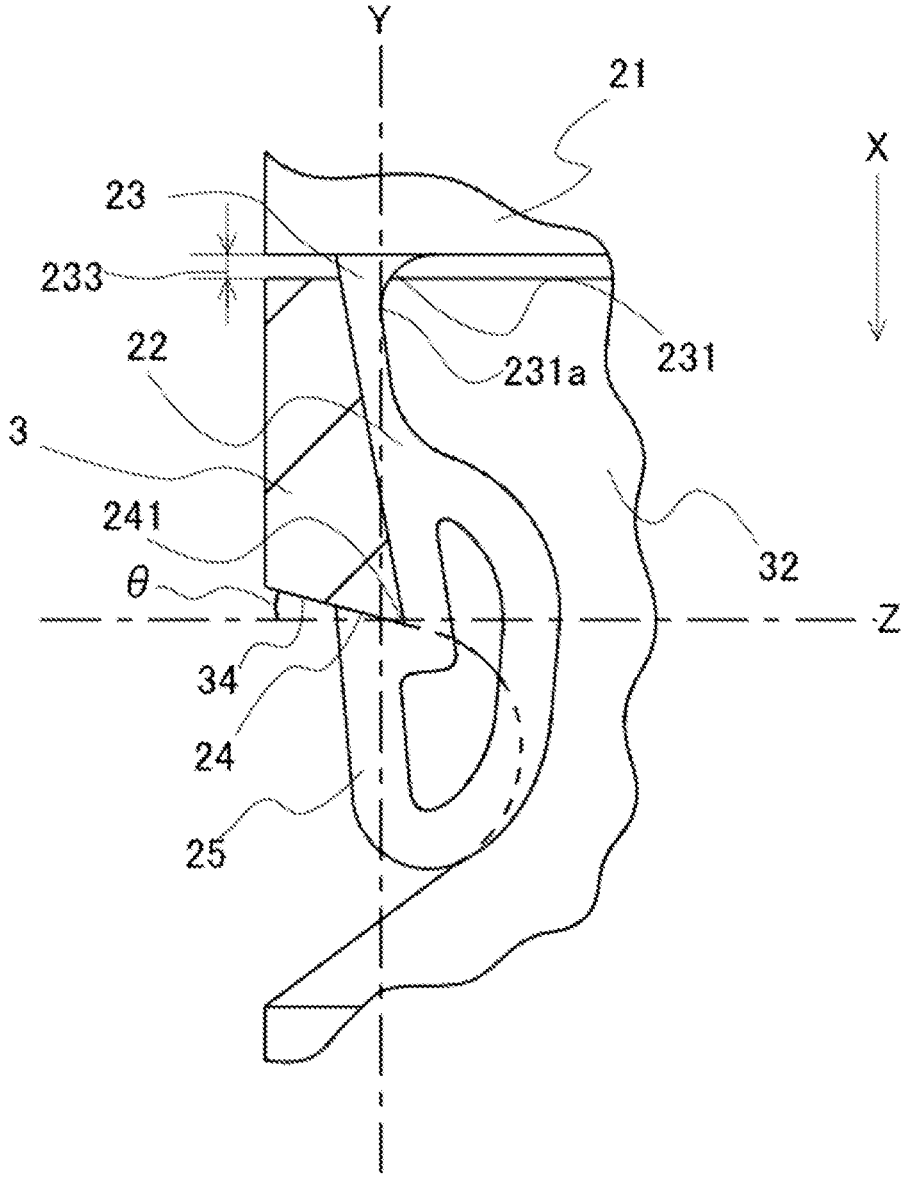
FIG. 3 is a partial enlargement view (No. 1) showing an arrangement relation between a proximal end of the arm and a second latch surface of the buckle according to the embodiment of the present invention.
Figure 4:
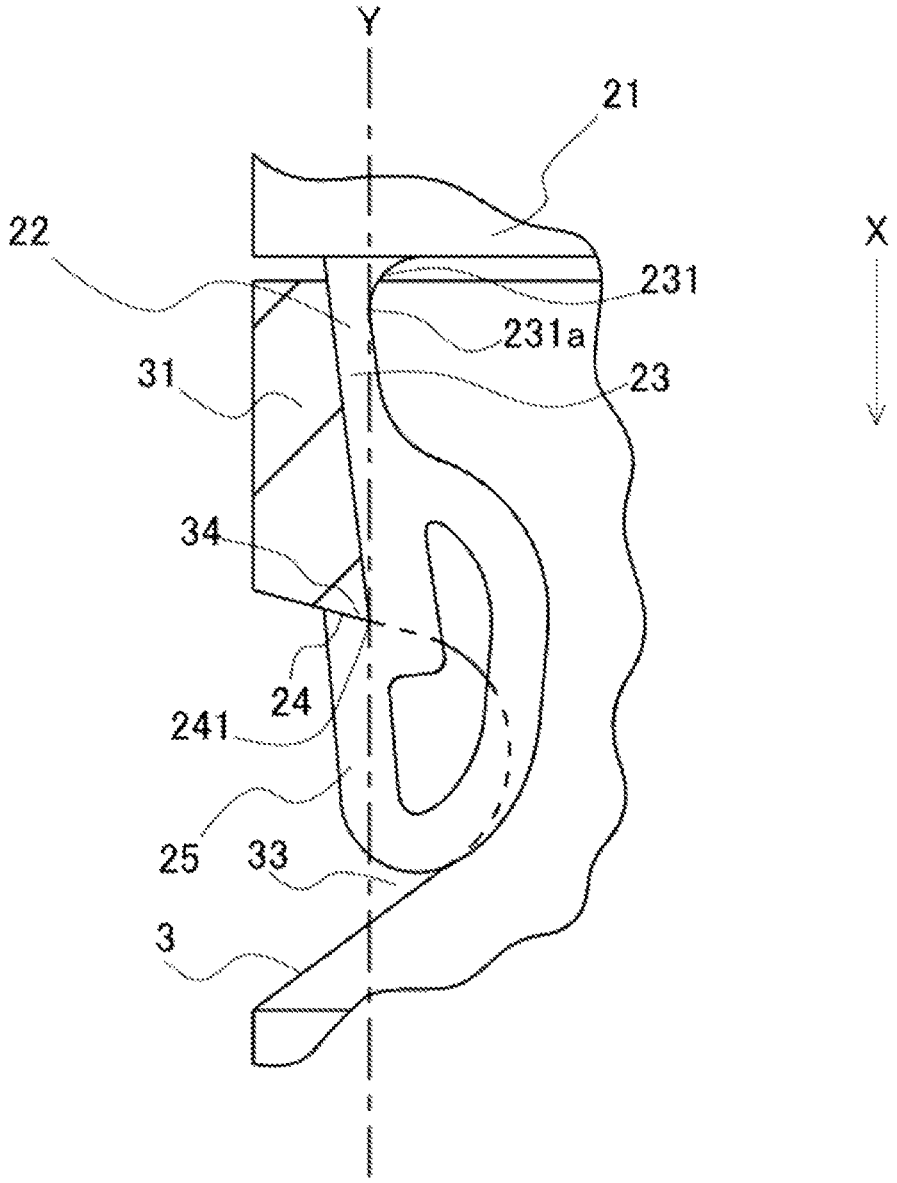
FIG. 4 is a partial enlargement view (No. 2) showing the arrangement relation between the proximal end of the arm and the second latch surface of the buckle according to the embodiment of the present invention.

As shown in FIG. 3 and FIG. 4, a line Y is drawn so as to extend in parallel to the insertion direction X of the plug 2 and pass through an inner side portion 231*a* located at the outermost portion, on an inner side 231 of the proximal end 23 of the arm 22. Then, an inner end 241 of the second latch surface 24 is preferred to be located in contact with the line Y as shown in FIG. 4 or arranged inner than the line Y as shown in FIG. 3. Since this positional relation is employed, the engagement between the second latch surface 24 and the first latch surface 34 of the socket 3 is made surer, which can provide the buckle 10 that is high in tensile strength and is unlikely to be separated even if an external force is added in a direction in which the plug 2 is pulled out from the socket 3, after the buckle 10 is attached.

As shown in FIG. 3, a line Z vertical to the insertion direction X (or the line Y) of the plug is drawn, and an angle of the second latch surface 24 that is viewed from the line Z is defined as an inclination angle θ (in this embodiment, in a case of the arm 22 shown in FIG. 3, the inclination angle θ is defined as an angle that is measured clockwise from the line Z, and in a case of the arm 22 on the right of FIG. 1, the inclination angle θ is defined as an angle that is measured counterclockwise from the line Z (which is not shown in FIG. 1). When the inclination angle θ is excessively great, the plug 2 must be inserted into the deeper portion of the socket 3, in order to realize the engagement between the first latch surface 34 of the socket 3 and the second latch surface 24 of the plug 2. For this reason, a margin 233 of the proximal end 23 of the plug 2 must be reserved greater. When the margin 233 is excessively reserved, there is a case that backlash is generated in the buckle 10, after the buckle 10 is attached. Thus, the excessive reservation of the margin 233 is not preferable. On the other hand, when the inclination angle θ is excessively small or becomes negative (namely, when the second latch surface 24 is inclined toward the lower portion on a paper surface as it approaches the outer side), the plug 2 and the socket 3 are likely to be separated by an unintended force. Hence, the inclination angle θ is preferable between 10 degrees and 20 degrees, preferably between 15 and 20 degrees, more preferable at 15 degrees.

When the buckle 10 according to the embodiment of the present invention is attached, as shown in FIG. 1, the arms 22 of the plug 2 and the hollow part 32 of the socket 3 are opposed to each other, and the arms 22 are inserted from the insertion port 35 into the hollow part 32. And, while outer sides 252 of the arms 22 are brought into contact with inner wall surfaces 361 of the main body 31 of the socket 3, the arms 22 are inserted up to the deep portion of the hollow part 32. Then, as shown in FIG. 2, in the opening 33 of the socket 3, the arms 22 are outwardly enlarged, and the distal ends 25 of the arms 22 are exposed from the openings 33. Simultaneously, the first latch surfaces 34 and the second latch surface 24 are opposed to and engaged with each other. When the buckle 10 is detached, the outer sides 252 of the pair of distal ends 25 that are exposed from the opening 33 of the socket 3 are pushed in respective inner directions (arrows A) by fingers of a user and the like. Consequently, the engagement between the first latch surfaces 34 and the second latch surfaces 24 is disengaged. Then, the plug 2 may be pulled out.

In the buckle 10 according to the embodiment of the present invention, the minimum tensile strength is 1335 N or more, and a release load is between 15 N and 25 N, and more preferable between 18 N and 22 N. Consequently, it is possible to provide the buckle in which, even if the plug is pulled in the direction opposite to the insertion direction after the plug is inserted into the socket, the strength is high to an extent that the engagement state between the plug and the socket can be kept without any separation of the plug, and when the buckle is detached, the buckle can be removed by a small load. A method of measuring the least tensile strength and the release strength will be concretely indicated below.

Figure 5:
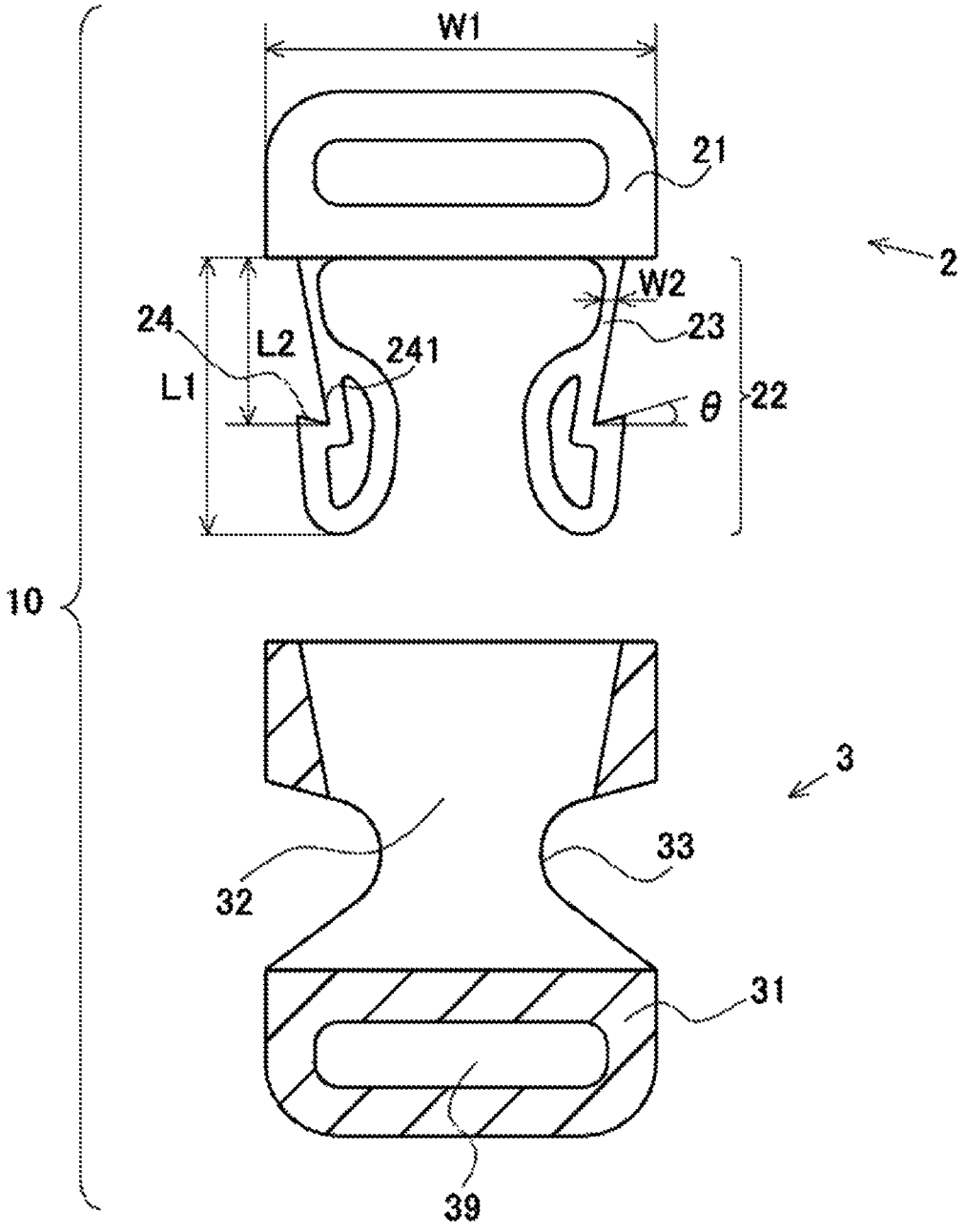
FIG. 5 is a partial cross-sectional view showing an example of the buckle according to the embodiment of the present invention which is used in an example of the present embodiment.
Figure 6:
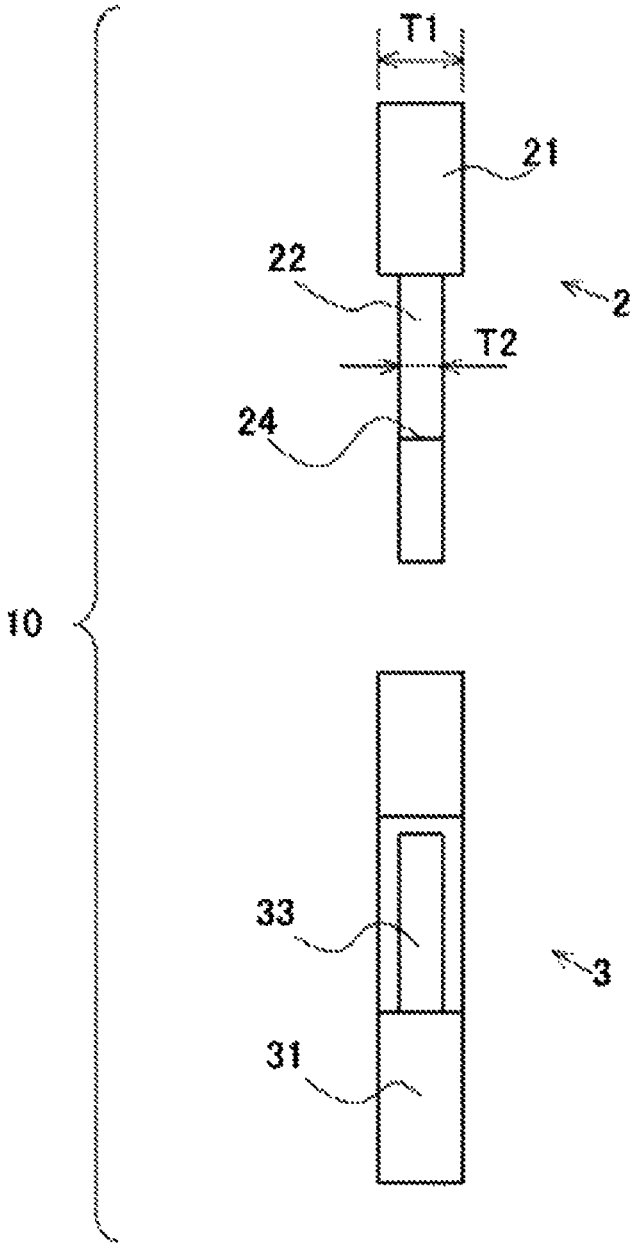
FIG. 6 is a side view of the buckle in FIG. 5.

For the buckle 10 according to the embodiment of the present invention, its strength analysis was carried out by using a simulation. The analysis was carried out by using a workstation (HP Z800) made by Hewlett-Packard Development Company, and its evaluation was carried out by using a commercial simulation software (DEFORM-3D). With regard to a plug for a test, as shown in FIG. 5, its parameters were set such that for a width of the base 21, W1=32 mm, and for a width of the thinnest portion of the proximal end 23, W2=1.2 mm, and for a length of the arm 22, L1=22.5 mm, and for a length from one end of the proximal end 23 to the inner end 241 of the second latch surface 24, L2=13.5 mm, and for the inclination angle, θ=15°, and for a thickness of the base 21, T1=11.5 mm, and for a thickness of the arm 22, T2=6 mm, as shown in FIG. 6. Then, the minimum tensile strength and the release strength were analyzed.

When the minimum tensile strength was measured, in a situation in which the corded members such as belts and the like were attached to the attachments 29 and 39 of the plug 2 and the socket 3, respectively, the respective corded members were fixed to a universal tension tester (Model: 5565 Type) made by INSTRON COMPANY. Then, by using the tension tester, each corded member was pulled in the direction opposite to the insertion direction. Consequently, the plug 2 and the socket 3 were pulled in the direction opposite to the insertion direction (X). A force required until with this pulling action, the plug 2 was separated from the socket 3 or one of the plug 2 and the socket 3 was broken (for example, the break of the proximal end 23 of the arm 22 and the like) was measured, and this was determined as "Minimum Tensile Strength".

When the release strength was measured, a digital force gauge (Model: ZP50N) made by IMADA CO., LTD was used. By using this apparatus, the distal ends 25 of the arms 22 were pushed in a direction in which both of the distal ends 25 came close to each other. Then, a force required until the engagement state between the first latch surface 34 and the second latch surface 24 were disengaged was measured, and this was determined as "Release Strength".

In the buckle 10 according to the embodiment, the minimum tensile strength indicated a high value of 1822 N. On the other hand, the release load indicated a relatively small value of 19.6 N. This indicates the strong strength that greatly exceeds the tensile strength (1335 N or more) which is required for the buckle 10. Even the release load complies with a required load (25 N or less).

Figure 7:
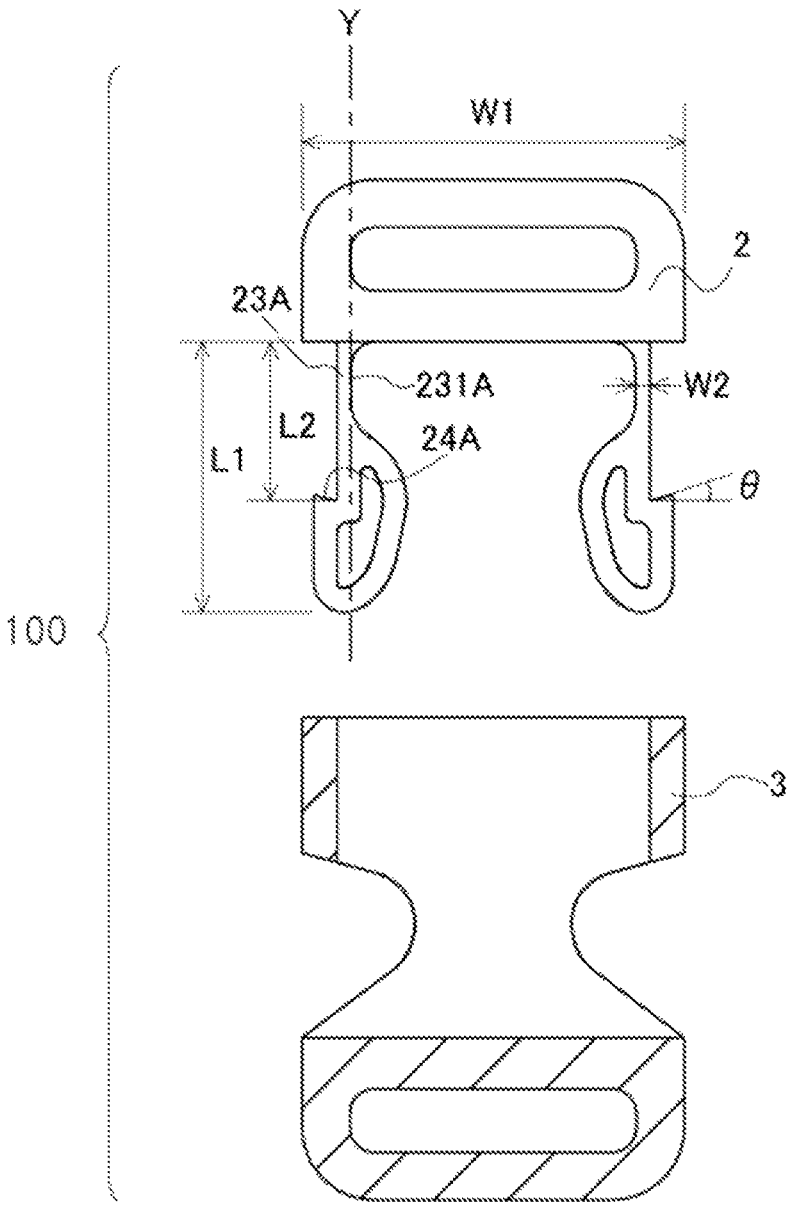
FIG. 7 is a partial cross-sectional view showing a comparative example 1 of the buckle.

As a comparative example 1, as shown in FIG. 7, the strength analysis based on the simulation was carried out by using a buckle 100 of a shape where a second latch surface 24A was positioned outer than a line Y, which extended in parallel to the insertion direction of the plug 2 and passed through an inner side portion 231A of a proximal end 23A. Respective dimensions in FIG. 7 were assumed such that W1=32 mm, W2=1.2 mm, L1=22.5 mm, L2=13.5 mm, θ=15°, T1=11.5 mm, and T2=6 mm, and the analysis was carried out. In the comparison 1, the minimum tensile strength was 940 N, and the release load was 18.8 N. Thus, the strength was not enough.

Figure 8:
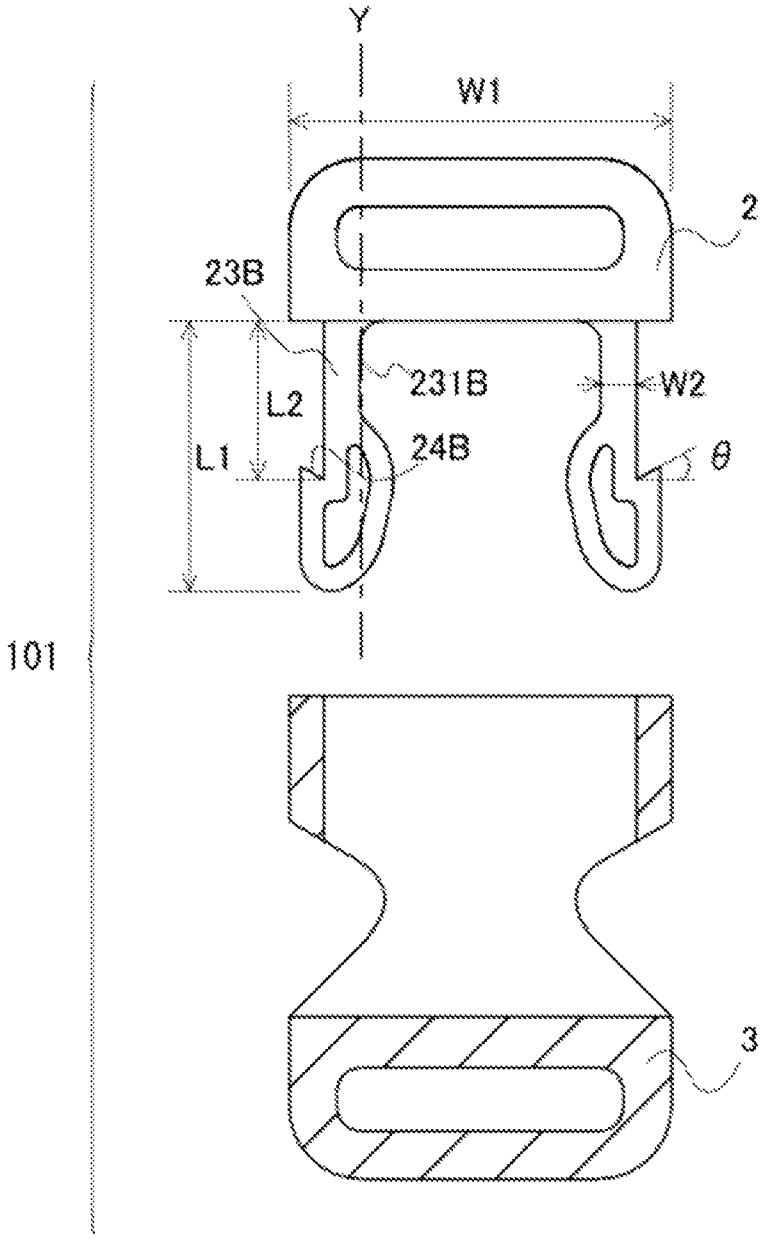
FIG. 8 is a partial cross-sectional view that shows a comparative example 2 of the buckle.

As a comparative example 2, as shown in FIG. 8, in a buckle 101 of a shape where a second latch surface 24B was positioned outer than a line, which extended in parallel to the insertion direction of the plug 2 and passed through an inner side portion 231B of a proximal end 23B, a simulation was carried out by changing a thickness of the proximal end 23B and a value of the inclination angle θ. Respective dimensions in FIG. 8 were assumed such that W1=32 mm, W2=3 mm, L1=22.5 mm, L2=13.5 mm, θ=30°, T1=11.5 mm, and T2=6 mm, and the analysis was carried out. In the comparison 2, the minimum tensile strength was 1346 N, and the strength had an excellent value. However, the release load became excessively high such as 47 N.

As explained above, various embodiments of the present invention is disclosed. However, that it will be understood that the descriptions and figures which are part of this disclosure do not limit the scope of this invention. It should be appreciated that various embodiments of the present invention which are not clearly disclosed herein would be included and they will be modified and performed without departing from the spirits thereof at the time of reduction to practice.

DESCRIPTION OF REFERENCE NUMBERS

1, 10, 100 Buckle
2 Plug
3 Socket
21 Base
22 Arm
23, 23A, 23B Proximal end
24, 24A, 24B Second latch surface
25 Distal end
27 Swell portion
28 Hole
29 Attachment
31 Main body
32 Hollow part
33 Opening
34 First latch surface
35 Insertion port
36 Wall portion
39 Attachment
231, 231A, 231B Inner side portion
233 Margin
241 Inner end
252 Outer side
361 Inner wall surface
362 Outer wall surface
363 Insertion-port-side wall surface
364 Opening-side wall surface

What is claimed is:

1. A buckle comprising:

a socket and a plug, wherein the socket comprises: a cylindrical main body having an insertion port into which the plug is can be inserted at one end and an attachment to which a corded member is attachable at another end; a hollow part formed within the main body; a pair of left and right openings continuous to the hollow part and penetrating through wall parts of the main body; and a pair of left and right first latch surfaces defined on opening-side wall surfaces of the wall parts of the main body and exposed from the openings to the attachment, the opening-side wall surfaces inclined in a direction intersecting with an insertion direction of the plug, wherein the plug comprises: a base to which a corded member is attachable; a pair of left and right arms extended from one end of the base; and a pair of left and right second latch surfaces protruding outward from outer sides of the arms, respectively, and inclined in the direction intersecting with the insertion direction of the plug, respectively, the second latch surfaces engagable with the first latch surfaces, and wherein, when the plug is inserted into the socket in a fully engaged position, inner ends of the second latch surfaces are either (1) brought into contact with lines that extend in parallel to the insertion direction of the plug and pass through inner side portions located at outermost portions on inner sides of proximal ends of the arms, or (2) disposed further inside the lines.

2. The buckle of claim 1, wherein an inclination angle θ of each of the second latch surfaces is between 10 degrees and 20 degrees, wherein the inclination angle θ is an angle between the second latch surfaces and a line perpendicular to the insertion direction.

3. The buckle of claim 1, wherein the buckle has a minimum tensile strength of 1335N or more and a release load of between 15 N and 25 N.

4. The buckle of claim 1, wherein each of the arms comprises a pillared proximal end connected to the base and a distal end continuous to the proximal end and further protruded from the proximal end toward the insertion direction of the plug, and wherein the distal end comprises a swell portion that is inwardly swelled.

* * * * *